US011255054B2

(12) United States Patent
Zürcher

(10) Patent No.: US 11,255,054 B2
(45) Date of Patent: Feb. 22, 2022

(54) DEVICE AND METHOD FOR BUILDING A NEW BALLASTWAY FOR A RAIL LINE

(71) Applicant: Zürcher Holding GmbH, Meißenheim (DE)

(72) Inventor: Ralf Zürcher, Meißenheim (DE)

(73) Assignee: Zürcher Holding GmbH, Meißenheim (DE)

( * ) Notice: Subject to any disclaimer, the term of this patent is extended or adjusted under 35 U.S.C. 154(b) by 0 days.

(21) Appl. No.: 17/276,618

(22) PCT Filed: Jul. 17, 2019

(86) PCT No.: PCT/EP2019/000219
§ 371 (c)(1),
(2) Date: Mar. 16, 2021

(87) PCT Pub. No.: WO2020/074113
PCT Pub. Date: Apr. 16, 2020

(65) Prior Publication Data

US 2021/0317614 A1 Oct. 14, 2021

(30) Foreign Application Priority Data

Oct. 8, 2018 (EP) ..... 18000798

(51) Int. Cl.
*E01B 27/02* (2006.01)

(52) U.S. Cl.
CPC ..... *E01B 27/028* (2013.01)

(58) Field of Classification Search
CPC . E01B 1/00; E01B 27/00; E01B 27/02; E01B 27/022; E01B 27/028; E01B 27/04; E01B 27/06; E01B 27/11; E01B 27/20; E01B 29/00; E01B 33/00; E01B 37/00
See application file for complete search history.

(56) References Cited

FOREIGN PATENT DOCUMENTS

| | | | |
|---|---|---|---|
| DE | 36 07 245 | 9/1987 | |
| DE | 38 34 313 | 4/1990 | |
| DE | 3834313 A1 * | 4/1990 | ..... E01B 27/02 |
| DE | 199 35 598 | 2/2001 | |

(Continued)

*Primary Examiner* — Robert J McGarry, Jr.
(74) *Attorney, Agent, or Firm* — Gudrun E. Huckett

(57) ABSTRACT

The present invention relates to a method and a device for building a new ballastway for an at least single-track rail line (100, 101) when there is initially no existing track. The new ballastway should have at least one PS layer (2) and one ballast layer (3), and the PS layer (2) is built up on a subgrade (1) and the ballast layer (3) is built up on the PS layer (2) in a continuous working process in a working direction (A). The PS layer (2) is built up by a PS layer-producing unit (20) (PSL unit), and the ballast layer (3) is built up by a ballast bed-producing unit (30), which is operated at a predefined distance behind the PSL unit (20) in relation to the working direction (A) and is equipped with a chain track or caterpillar track (31) for driving on the PS layer (2). The PSL unit (20) and the ballast bed-producing unit (30) are each supplied with the materials (K, S) needed to build up the PS layer (2) and the ballast layer (3) by means of an associated conveying device (12*a*, 12*b*) from at least one open-top wagon (10*a*, 10*b*), which is operated at a predefined distance in front of the PSL unit (20) in relation to the working direction (A).

9 Claims, 12 Drawing Sheets

(56) References Cited

FOREIGN PATENT DOCUMENTS

| | | | | |
|---|---|---|---|---|
| DE | 202005004049 U1 * | 7/2005 | ..... | E01C 19/48 |
| DE | 20 2005 004 049 | 8/2005 | | |
| DE | 2 295 638 | 3/2011 | | |
| DE | 2 708 648 | 3/2014 | | |

* cited by examiner

DEVICE AND METHOD FOR BUILDING A NEW BALLASTWAY FOR A RAIL LINE

BACKGROUND OF THE INVENTION

The invention concerns a method and a device for building a new ballastway for an at least single-track rail line for an initially non-existing track.

It is known in the prior art that, for building a trackway, different materials in variable widths and thicknesses, depending on the predefined transverse profile of the rail track, are required and installed. These layers are comprised of a sub-ballast, the so-called protective subgrade layer (abbreviated in the following as PSL or PS layer), that is comprised of gravel-sand mixtures of different compositions or, as needed, of asphalt, and of a ballast layer that is comprised of ballast stones (hard stone, e.g., granite) of a defined grain size fraction.

The installation of this track support in conformity with rules is realized on a ground subgrade that is comprised of a load-bearing substrate, e.g., gravel or stone. The thickness and the transverse profile configuration of the individual PS and ballast layers can be very different in this context. Trackways can be comprised in this context of a single-track or of several, at least substantially parallel, tracks.

Up to now, the materials for a new rail track, comprising PS layer and ballast layer, for a non-existing track are transported, depending on the locality, by trucks and unloaded. This can also be done by a railway car when there is already a track in existence in the vicinity of the new ballastway. After unloading the materials, they are installed and compacted in layers in accordance with height, width, and transverse profile specifications of the planned track system. The installation of the individual layers is realized in this context in separate work procedures. First, the PS layer of the gravel-sand mixture must be installed. In individual cases, e.g., in Switzerland, this PS layer can also be comprised of asphalt.

After the proper installation of the PS layer according to profile, the installation of the ballast layer for the region of upper edge of the PS layer to the intended bottom edge of the railroad ties of the track that is to be newly laid is realized in a separate work procedure. Frequently, the installation of the new PS and ballast layers is carried out with market-conventional construction machines and devices in different ways, depending on the locality and the construction variant.

The installation of the PS and ballast layers can be realized by means of truck, excavator, bulldozer, compactor, installation finisher or the like, wherein care must be taken that the finished PS layer, prior to application of the ballast layer, must not have any unevenness and therefore must not be driven on by trucks or any wheeled vehicle.

Therefore, DE 38 34 313 A1 discloses a method for building a trackway in which a ballast layer is finished by means of a ballast finisher and a pre-finished PS layer is finished by means of a leading PSL finisher. Both finishers have a crawler running gear in order not to damage the PS layer. The PSL finisher comprises, viewed from the front, a supply bunker from which a belt conveyor extends to the ballast finisher. The supply bunker can be loaded from a truck with ballast because the path of the pre-finished PS layer traveled on for this purpose is smoothed and compacted, as needed, by the PSL finisher in the following.

If present, existing tracks or paths which already extend adjacent to the trackway that is to be built can be used for material supply as an alternative thereto. Moreover, special complex trackway construction trains can be employed that install PS layer and ballast layer at the head and apply thereon the track, wherein these construction trains have a running gear at the head for traveling on the substructure and, to the rear, have a rail running gear for traveling on the newly laid track.

In this context, EP 2 295 638 B1 discloses a method and a work car for building a track body in which first the rails are placed on the track substructure and, by means of the work car, the ballast is applied on the track substructure at the head, then the railroad ties are applied on the ballast, and subsequently the previously laid rails, threaded into the work car, are applied. The work car comprises for this purpose a crawler running gear and a rail vehicle at the rearward end and is thus moved partially on the already finished track body. The method can moreover provide that a PS layer is applied beforehand below the ballast. For application of the PS and ballast layers, the work car comprises a respective installation device one behind the other in front of the crawler running gear wherein the materials required for installation are supplied by belt conveyors from corresponding material cars which are arranged behind the work car in the working direction.

EP 2 708 648 discloses a device for building a track in which the required materials for installation of the PS layer and the ballast layer are supplied by belt conveyors from the material cars which are arranged in the working direction behind the device for building the track, which here is comprised of leading, separate and decoupled installation finishers that comprise a wheel or crawler running gear behind which a respective installation device for the PS layer or the ballast layer is arranged.

With such devices, a new ballastway, comprising PS layer and ballast layer, can be built in a single continuous work procedure but these complex construction trains, which in addition require a plurality of material cars and corresponding conveying logistics for material supply, are much more cost-intensive in comparison to conventional construction in which the PS layer and the ballast layer are built sequentially in separate work procedures with conventional machines and devices.

Based on this prior art, it is object of the present invention to provide a simplified, faster, and more cost-efficient continuous method for building the PS and ballast layers of a new ballastway without a PS layer built during the construction becoming damaged and without it being necessary to utilize parallel paths or tracks.

SUMMARY OF THE INVENTION

This object is solved by a method characterized in that the PS layer is built by a PS layer finisher (PSL finisher) and the ballast layer is built by a ballast bed finisher which is operated at a predetermined distance behind the PSL finisher in relation to the working direction and is provided with a chain or crawler running gear for traveling on the PS layer, wherein the materials required for building the PS layer and the ballast layer are supplied to the PSL finisher and to the ballast bed finisher by means of a respective correlated conveying device from at least one open-top car which is operated at a predetermined distance in front of the PSL finisher in relation to the working direction.

The further object of providing a device suitable for performing the method is solved in that the device comprises at least one PSL finisher, at least one ballast bed finisher that is provided with a chain or crawler running gear for traveling on the PS layer, at least one open-top car and conveying devices that are correlated with the PS finisher and with the ballast bed finisher in a work constellation in which the ballast bed finisher can be operated at a predetermined distance behind the PSL finisher in relation to the work direction, the open-top car can be operated at a predetermined distance in front of the PSL finisher in relation to the working direction, and the conveying devices extend from the at least one open-top car to the PSL finisher and to the ballast bed finisher, respectively.

Further embodiments are disclosed in the respective dependent claims.

The method according to the invention relates to building a new ballastway for an at least single-track rail line with initially non-existing track.

"Initially non-existing track" relates to the state of the planned new ballastway prior to the begin of the method, i.e., the method is used in an initial situation in which along the planned new ballastway no existing railway track is existing.

In other words, a method for the first construction of an at least single-track rail line substructure is concerned, wherein "substructure" in the present case is understood as the PS layer built on the ground subgrade and the ballast layer or ballast bed constructed thereon. The method does not relate to restoration of these layers for an existing rail line.

A first embodiment of the method according to the invention, in which the PS layer is built on the ground subgrade and the ballast layer on the PS layer in a continuous work sequence in a working direction, comprises that the construction of the PS layer is performed by a protective subgrade layer finisher (PSL finisher) and the construction of the ballast layer is performed by a ballast bed finisher. The ballast bed finisher is operated at a predetermined distance behind the PSL finisher in relation to the working direction on the PS layer that has been constructed by the PSL finisher. In order not to damage the PS layer, a ballast bed finisher is employed that is provided with a chain or crawler running gear. In order for the two installation finishers to be able to simultaneously and continuously build the two layers, the method comprises moreover supplying the materials required for building the PS layer and the ballast layer from one or a plurality of open-top cars to the PSL finisher and to the ballast bed finisher, wherein correspondingly correlated conveying devices are employed which extend from the open-top car (or cars) to the respective PSL finisher and to the ballast bed finisher. The open-top car or cars are operated at a predetermined distance in front of the PSL finisher in relation to the working direction, i.e., are moved forwardly with the same speed as the PSL finisher and the ballast bed finisher in a continuous work sequence in the working direction while the material supply from the open-top car via the conveying devices to the installation finishers is realized in the opposite direction.

In this context, in the method according to the invention, generally known installation finishers for the PS layer and the ballast bed layer are employed now in connection with open-top cars and conveying devices in an advantageous work constellation that enables the installation of a new ballastway in case of an initially non-existing track in a continuous work sequence with simultaneous construction of the PS layer and ballast layer not only significantly simpler and at the same time faster in comparison to the prior art, but also in a less expensive manner, because complex machine trains which require a material supply from material cars that are track-bound can be dispensed with. Damage of the PS layer by the ballast bed finisher is avoided in that the ballast bed finisher comprises a chain or crawler running gear. Advantageously, PSL finisher and open-top cars that travel on the ground subgrade can also comprise a chain or crawler running gear which is in particular advantageous in case of wet weather.

Even though the different materials required for building the layers—e.g., for the PS layer a gravel-sand mixture or, as needed, asphalt and for the ballast layer ballast stones of a certain grain size—can be stored in a single open-top car that is provided with separate sections for this purpose, in a further advantageous embodiment of the method according to the invention it can be provided that for each of the different materials its own open-top car is employed, i.e., the material required for the PS layer is stored in a first open-top car and the material required for the ballast layer in a second open-top car. The material required for the PS layer is then transported from the first open-top car via the correlated conveying device to the receiving device of the PSL finisher. Correspondingly, the material required for the ballast layer is transported from the second open-top car, which is operated adjacent to the first open-top car, by the correlated conveying device to a receiving device of the ballast bed finisher.

In a particularly advantageous further embodiment of the method, it is provided that, for producing a new ballastway for a double-track or multi-track rail line, a ballast bed finisher is employed for each of the tracks of the line to be constructed, respectively. Since the two or more ballast bed finishers are employed adjacent to each other, the ballast beds of the new ballastway for the double-track or multi-track rail line are produced simultaneously. Depending on the width of the new ballastway, a single PSL finisher may be sufficient in this context behind which the two or more ballast bed finishers build the ballast beds adjacent to each other on the PS layer. Each one of the ballast bed finishers is supplied in this context by a correspondingly correlated conveying device with the required material for constructing the respective ballast layer from the at least one open-top car; preferably however, for each one of the ballast bed finishers its own separate open-top car is provided from which a respective conveying device extends past the PSL finisher to the correlated ballast bed finisher. The two or more open-top cars that are employed in correspondence to the two or more ballast bed finishers are arranged preferably adjacent to each other and adjacent to the open-top car that is correlated with the PSL finisher. As an alternative to the parallel use of e.g. two ballast bed finishers adjacent to each other for building the ballast beds of a double-track rail line, a method variant can provide the use of a special ballast bed finisher that comprises two installation devices which are arranged adjacent to each other for installation of the two parallel ballast layers.

As needed—depending on the provided number of track lines and their gauge or the provided total width of the new ballastway—more than one PSL finisher may be required. Then, in accordance with a further embodiment of the method according to the invention, two or more PSL finishers can also be employed adjacent to each other to which the required material from the leading open-top car, preferably its own leading open-top car, respectively, is supplied by a correlated conveying device.

The installation of the materials required for the PS layer and the ballast layer is realized respectively by an installation device of the PSL finisher and of the ballast bed finisher, wherein the installation device of the PSL finisher installs the PS layer and the installation device of the ballast bed finisher installs the ballast layer in accordance with a predetermined profile for the PS layer and the ballast layer, respectively. The respective profile may comprise specifications for e.g. height, width, shape, position, and slant of the respective layer.

A further embodiment of the method according to the invention relates to linking and automation of the work sequences of the method and comprises surveying, leveling, and recording of heights and lateral positions of the ground subgrade and accounting for these heights and lateral positions of the ground subgrade in predetermining the respective profile of the PS layer and of the ballast layer. Preferably, for surveying, leveling, and recording of the heights and lateral positions of the ground subgrade, surveying and leveling devices can be employed that are linked by at least one control unit with the respective installation device so that the installation of the PS layer and of the ballast layer is realized in an automated fashion in accordance with the respective predetermined profile.

Surveying is realized usually by means of a guideline that is usually calibrated beforehand at the lateral edge, which may be a wire string, for example. The guideline is used as a sensing line for the installation finishers that sense thereat the measurement continuously during advancing movement. As an alternative thereto, a method variant can provide a directional guiding action controlled by laser point.

The automation of the method sequences is enabled by the use of the leading open-top cars that ensure a continuous material supply not only for building the ballast layer but also for building the PS layer. In this context, material dump piles are avoided that have been used for material supply in the prior art for separate installation of the PS layer and of the ballast layer in a discontinuous working procedure. The discontinuous material supply per dump piles causes again and again new joining points upon installation of the layers in order to obtain the desired profile, which is also avoided with the method according to the invention. Advantageously, by means of the method according to the invention, the layer continuity and homogeneity of the PS layer and of the ballast layer can be achieved more easily.

In order for the method to be performed in a uniform, continuous work sequence, a further embodiment of the method according to the invention provides that, on the one hand, a travel speed of the PSL finisher, of the ballast bed finisher, and of the at least one open-top car are matched to each other such that the installation finishers and the open-top cars are moved forward substantially at the same speed. By suitable selection of the distances that are predetermined between the ballast bed finisher and the PSL finisher as well as between the PSL finisher and the open-top car, certain fluctuations are acceptable and can be compensated as long as the discharge end of each conveying device is located above the receiving device of the correlated finisher. When the receiving device extends across a larger surface area of the finisher, sufficient tolerances for fluctuations are provided here also. Preferably, the leading open-top cars are operated separate from the installation finishers and have therefore their own drive. With operative coupling of the drives of open-top cars and installation finishers for adaptation to the same speed at which the open-top cars and the installation finishers are moved forward, the conveying device can have, as needed, a fixed connection or support between the respective installation finisher and the correlated open-top car.

Moreover, the method comprises in this further embodiment matching of the installation speeds of the PSL finisher and of the ballast bed finisher relative to each other as well as matching of the travel speed of the PSL finisher, of the ballast bed finisher, and of the at least one open-top car to the installation speeds of the PSL finisher and of the ballast bed finisher. Moreover, a conveying speed of the conveying devices is matched to the installation speed of the PSL finisher and of the ballast bed finisher. This can be done preferably by electronic control or regulation.

In a further embodiment of the method according to the invention, an additional leveling and/or compaction of the respectively constructed PS layer and/or ballast layer can be realized for optimizing the installed layers, for which purpose a corresponding leveling and/or compaction device can be employed which—in relation to the working direction—is arranged behind the installation device of the PSL finisher or of the ballast bed finisher, respectively. In principle, leveling and compaction work is done already by the installation devices of the installation finisher; the additional leveling and compaction units which are arranged behind the installation finishers enable an optional or renewed subsequent processing of the material installed by the installation finishers.

Loading of the at least one open-top car with the materials required for building the PS layer and the ballast layer can be realized in a preferred embodiment of the method according to the invention by one or a plurality of trucks that approach the at least one open-top car from the front in relation to the working direction across the ground subgrade that can be traveled on by tires. The material supply with trucks is associated with significantly lower costs in comparison to the use of track-bound material cars. The open-top cars are preferably designed such that loading can be done simply by dumping the load of the truck which for this purpose assumes a position in front of the open-top car to be loaded in working direction.

It is provided that the forward movement of the open-top car to be loaded—and correspondingly of the remaining open-top cars and installation finishers—during docking and dumping of the truck at the open-top car to be loaded is maintained so that the method proceeds continuously in the working direction even during loading of the open-top car. For this purpose, after docking of the truck at the open-top car to be loaded and begin of the dumping process, the truck is shifted to idle so that the truck is pushed along in the working process until it is completely unloaded.

A further subject matter according to the invention is a corresponding device for building a new ballastway for an at least single-track rail line or for first installation of an at least single-track substructure for a rail line with initially non-existing track which can perform the method according to the invention. For this purpose, the device comprises in a defined work constellation at least one PSL finisher, at least one ballast bed finisher that is provided with a chain or crawler running gear for traveling on the PS layer, at least one open-top car, and conveying devices which are correlated with the PSL finisher and with the ballast bed finisher. In the work constellation, the ballast bed finisher can be operated at a predetermined distance behind the PSL finisher in relation to a working direction, the open-top car can be operated at a predetermined distance in front of the PSL finisher in relation to the working direction, and the conveying devices extend, in accordance with the correlation, from the at least one open-top car to the PSL finisher and to the ballast bed finisher, respectively.

The conveying devices of the device according to the invention can be in particular belt conveyors or band conveyors; however, other conveying devices such as, screw conveyors, chain trough conveyors or bucket conveyors are also conceivable.

In a preferred embodiment, the device comprises at least two open-top cars that can be operated adjacent to each other, wherein a first open-top car is correlated with the PSL finisher and a second open-top car is correlated with the ballast bed finisher. In this context, the PSL finisher and the ballast bed finisher each have a receiving device which, for example, can be embodied as a simple box without cover but with a large opening area. The respectively correlated conveying device is extending from the first open-top car and the second open-top car in accordance with the correlation to this receiving device or, more precisely, to its opening area. It can be provided in this context that each conveying device has a fixed connection to or support on the correlated installation finisher—the discharge end of each conveying device can however also be positioned without fixed connection or support above the respective receiving device. In a particular further embodiment, the conveying devices can be designed to be adjustable in length, position, and/or angle position so that a discharge end of the conveying device in relation to the receiving device is variably positionable. In this way, on the one hand, different installation finishers can be employed in a device according to the invention in that the discharge end of the conveying device can always be aligned with proper fit and, on the other hand, the predetermined distance of the installation finisher to the open-top car can be varied. In addition, an adjustable conveying device can also be employed to position the discharge end always above the receiving device, independent of the course of the rail line and of the topography, i.e., also in curves or corrugations in the course of the rail line.

In a further embodiment, the device according to the invention can comprise a ballast bed finisher for each of the tracks of the line to be built, respectively, wherein two or more ballast bed finishers can be operated adjacent to each other in the work constellation. Preferably, the device can have for each ballast bed finisher a correlated open-top car, respectively, so that the conveying devices can simply run parallel to the working direction and can extend from each open-top car to the correlated ballast bed finisher. Optionally, the device, as a function of a width of the new ballastway, can also comprise more than one PSL finisher, wherein also the PSL finishers can be operated adjacent to each other in the work constellation and each are preferably correlated with their own open-top car. An alternative work constellation provides instead of e.g. two or more ballast bed finishers adjacent to each other a special ballast bed finisher which, in accordance with the track lines to be built, comprises two or more installation devices that are arranged adjacent to each other for installation of the parallel ballast layers. Such a special ballast bed finisher can be provided with its own receiving device for each installation device to which material of a respectively correlated open-top car is supplied via a corresponding conveying device. When this special ballast bed finisher comprises only one receiving device that supplies both installation devices with ballast, the material supply to the single receiving device can be realized by a single correlated open-top car via a corresponding conveying device.

The PSL finisher and the ballast bed finisher each comprise an installation device which, in a preferred embodiment of the device, is embodied respectively to build the PS layer and the ballast layer in accordance with a predetermined profile for the PS layer and for the ballast layer, respectively, that may comprise height, width, shape, position, and slant. In this context, the device can moreover comprise for automation, as needed, surveying and leveling devices for surveying, leveling, and recording the heights and lateral position of the ground subgrade that are linked by at least one control unit with the respective installation device in order to predetermine the installation profile that the respective layer to be installed is to have. As an exemplary surveying and leveling device, each installation finisher can comprise a sensing device in order to sense a guideline that has previously been calibrated at the lateral edge of the new ballastway. A further example for a surveying and leveling device can be a directional guiding action controlled by laser point.

According to a further embodiment of the device according to the invention, at least the drives of the PSL finisher, of the ballast bed finisher, and of the at least one open-top car and the installation devices as well as the conveying devices can be linked with each other electronically, as needed by a control or regulating device, for automation of the work sequences in order to adjust in particular a travel speed of the PSL finisher, of the ballast bed finisher, and of the at least one open-top car and an installation speed of the PSL finisher and of the ballast bed finisher relative to each other. Moreover, preferably also by means of the control or regulating device, a conveying speed of the conveying devices can be matched to the installation speed of the PSL finisher and of the ballast bed finisher.

A further embodiment of the device according to the invention provides that the PSL finisher comprises an additional leveling and/or compaction device which is arranged for additional or renewed subsequent leveling and/or compaction of the installed PS layer behind the installation device of the PSL finisher in relation to the working direction. Alternatively or additionally, the ballast bed finisher of the device according to the invention can also comprise an additional leveling and/or compaction device which is arranged correspondingly behind the installation device of the ballast bed finisher in relation to the working direction.

Moreover, a further embodiment relates to the device comprising at least one truck which in the work constellation can be operated in front of the at least one open-top car in relation to the working direction in order to load the open-top car with the respective material.

Further embodiments as well as some of the advantages which are associated with these and further embodiments will be become clear and better understood by means of the following detailed description with reference to the accompanying Figures. Articles or parts thereof which are substantially identical or similar may be provided with the same reference characters. The Figures are only a schematic illustration of an embodiment of the invention.

BRIEF DESCRIPTION OF THE DRAWINGS

FIG. 1*a* shows a schematic side view and FIG. 1*b* shows a plan view of a device in a work constellation according to an embodiment according to the invention for a single-track line prior to loading of the open-top cars;

FIG. 2*a* shows a schematic side view and FIG. 2*b* shows a plan view of the device of FIG. 1*a* and FIG. 1*b* during loading of the open-top cars;

FIG. 3*a* shows a schematic side view and FIG. 3*b* shows a plan view of a device in work constellation according to an embodiment according to the invention for a single-track line with alternative arrangement of the conveying device, prior to loading of the open-top cars;

FIG. 4*a* shows a schematic side view and FIG. 4*b* shows a plan view of the device of FIG. 3*a* and FIG. 3*b* during loading of the open-top cars;

FIG. 5*a* shows a schematic side view and FIG. 5*b* shows a plan view of a device in work constellation according to a further embodiment according to the invention for a double-track rail line prior to loading of the open-top cars;

FIG. 6*a* shows a schematic side view and FIG. 6*b* shows a plan view of the device of FIG. 5*a* and FIG. 5*b* during loading of the open-top cars;

FIG. 7*a* shows a schematic side view of a built new ballastway with track and two plan views: FIG. 7*b* of a built single-track and FIG. 7*c* of a built double-track new ballastway with tracks;

FIG. 8*a* shows a schematic side view and FIG. 8*b* shows a plan view of a device in work constellation according to a further embodiment according to the invention fora double-track line with a PSL finisher with leveling/compaction device, prior to loading of the open-top cars;

FIG. 9*a* shows a schematic side view and FIG. 9*b* shows a plan view of the device of FIG. 8*a* and FIG. 8*b* during loading of the open-top cars;

FIG. 10*a* shows a schematic side view and FIG. 10*b* shows a plan view of a device in work constellation according to a further embodiment according to the invention for a double-track line with a PSL finisher and a ballast finisher with leveling/compaction devices, prior to loading of the open-top cars;

FIG. 11*a* shows a schematic side view and FIG. 11*b* shows a plan view of the device of FIG. 10*a* and FIG. 10*b* during loading of the open-top cars;

DESCRIPTION OF PREFERRED EMBODIMENTS

The new installation of trackbeds for track systems requires up to now two separate working steps for the construction of the PS layer and ballast layer when no complex construction trains that are track-bound are employed which complete the construction of the two layers with special devices at the head; this is associated with high costs.

Figure 12:
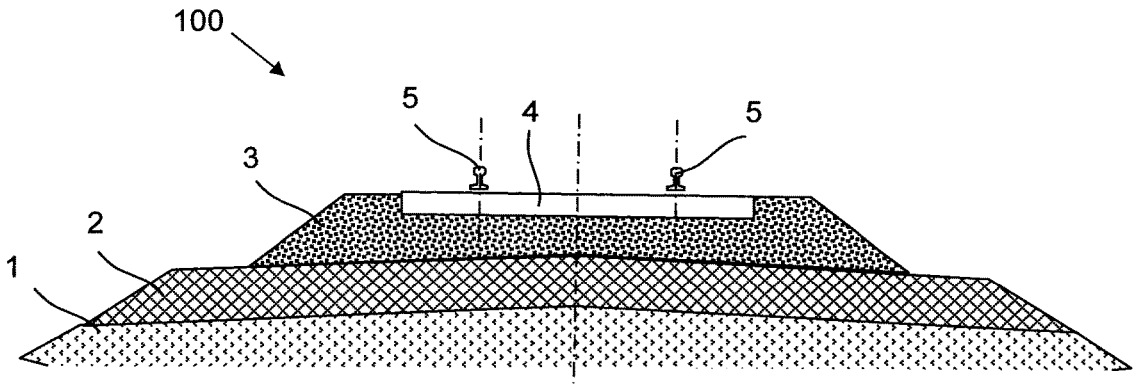
FIG. 12 a schematic cross section view of a single-track new ballastway.

FIG. 12 illustrates in simplified illustration the configuration of a single-track rail line 100 which comprises the trackbed of PS layer 2 and ballast layer 3 built on the ground subgrade 1. The railroad ties 4 (of which in the section illustration of FIG. 12 one can be seen) are recessed in the ballast bed 3 and the rails 5 are attached thereto. The ground subgrade 1 refers to the surface of the ground which has been appropriately machined with regard to flatness, slant, and profile-appropriate position. It can be seen in this context that the ground subgrade 1 has a roof-like slant in order to be able to discharge surface water reliably. The PS layer 2 which is built on the ground subgrade 1 comprises in the illustrated example a profile with corresponding roof-shaped slant while the ballast layer 3 installed thereon has a deviating profile with an approximately planar surface for the track of railroad ties 4 and rails 5.

The illustrated profiles of the PS layer 2 and of the ballast layer 3 are to be understood as an example. Modifications of the new ballastway to be produced with deviating profiles of the layers with regard to layer thickness, layer width, and layer slant as well as deviating heights and lateral positions of the new ballastway are encompassed by the claimed subject matter.

The method according to the invention that is performed inexpensively with a device according to the invention enables now the parallel installation of the PS and ballast layers 2, 3 continuously in a working direction without traveling with wheeled vehicles on the new PS layer 2, which is illustrated in an exemplary fashion with the aid of the embodiments in the FIGS. 1 to 11 and which is not possible with standard technologies, i.e., without the complex expensive track-bound construction trains. Due to the continuous installation in accordance with the invention without traveling across with wheeled vehicles, in particular the PS layer 2 is produced with the required homogeneity and the predefined profile essentially at the same time with the ballast layer 3 installed thereon, which is also provided uniformly with the predefined profile.

In the method according to the invention that relates to the simultaneous installation of the PS layer 2 and of the ballast layer 3, loading of the device with the materials K, S to be installed is realized from the ground subgrade 1, as illustrated in the Figures. The materials to be installed are in the following examples a sand-gravel mixture for the PSL and a stone ballast for the ballast layer but are not to be limited thereto. An alternative material for the PSL can be asphalt, for example.

Figure 1A:
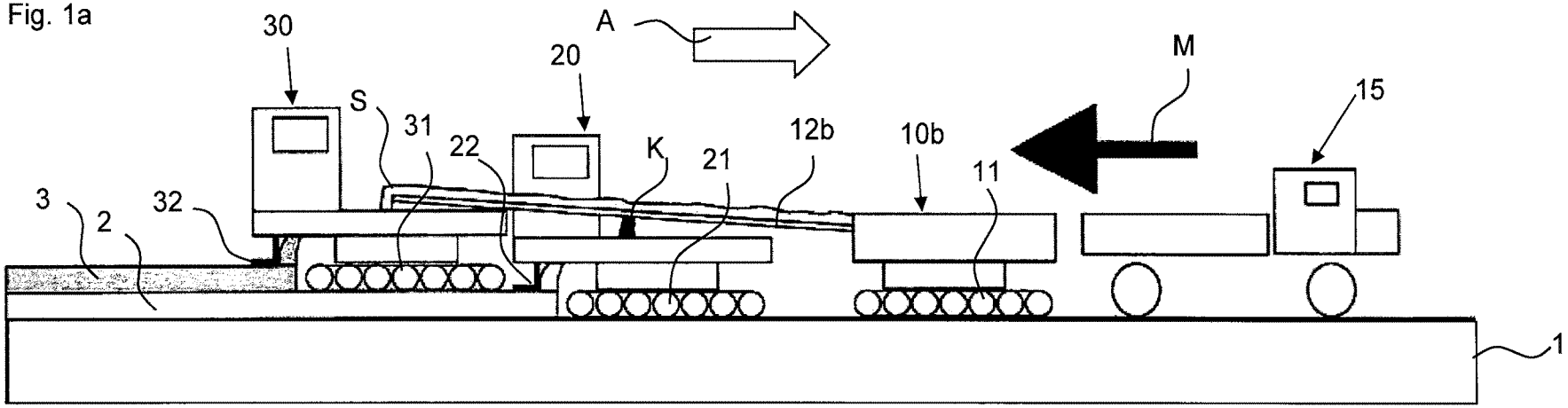
FIG. 1*a*, FIG. 1*b*.
Figure 1B:
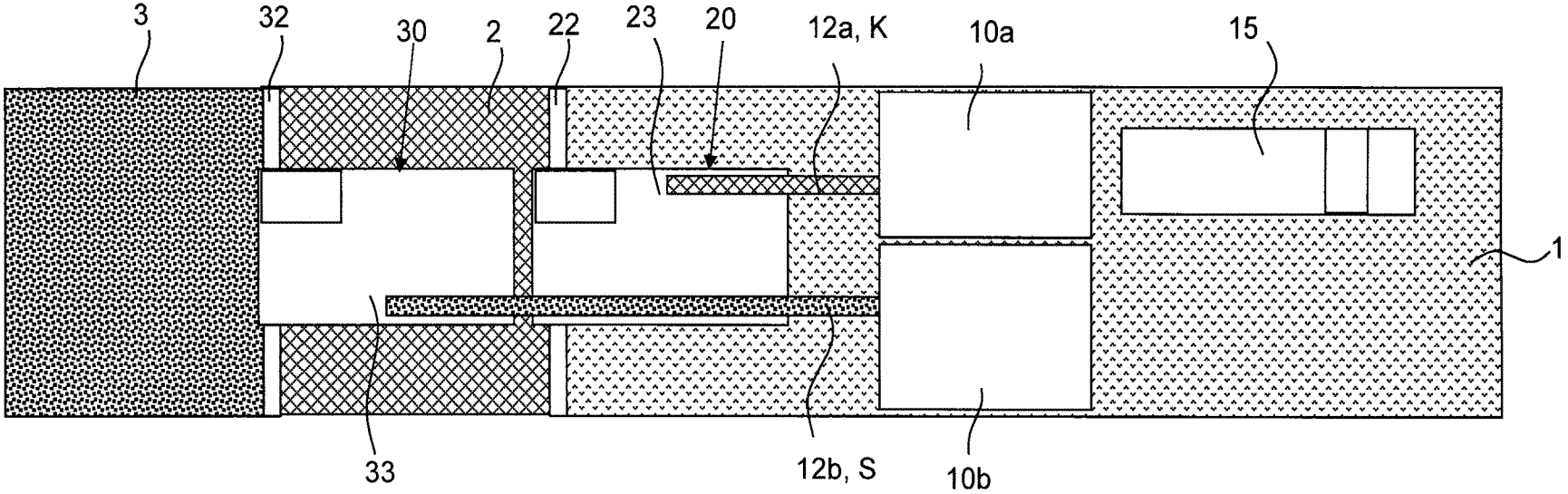

FIGS. 1*a,b* show a truck 15 for loading which, in relation to the working direction A, is in front of the open-top car 10*a*, 10*b* in which the materials K, S are stored. In the work constellation of the device according to the invention, a PSL finisher 20 and behind it a ballast bed finisher 30 are arranged behind the open-top cars 10*a*, 10*b* in the illustrated embodiment and are all being moved uniformly forward approximately at a constant speed in the working direction A. In this context, the open-top cars 10*a*, 10*b* and the PSL finisher 20, which here each have a chain running gear 11, 21, travel on the ground subgrade 1 while the PS layer 2 is installed by the PSL finisher 20 on the ground subgrade 1 by means of the installation device 22 which, for this purpose, is arranged behind the chain running gear 21. The ballast bed finisher 30 following the PSL finisher 20 travels on the newly installed PS layer 2 and comprises for this purpose a suitable chain or crawler running gear 31 in order to avoid destruction of the PS layer 2.

The ballast layer 3 is installed in this context parallel and also continuously on the PS layer 2 by the ballast bed finisher 30 which for this purpose comprises a corresponding installation device 32 which is arranged behind the chain or crawler running gear 31.

Figure 2A:
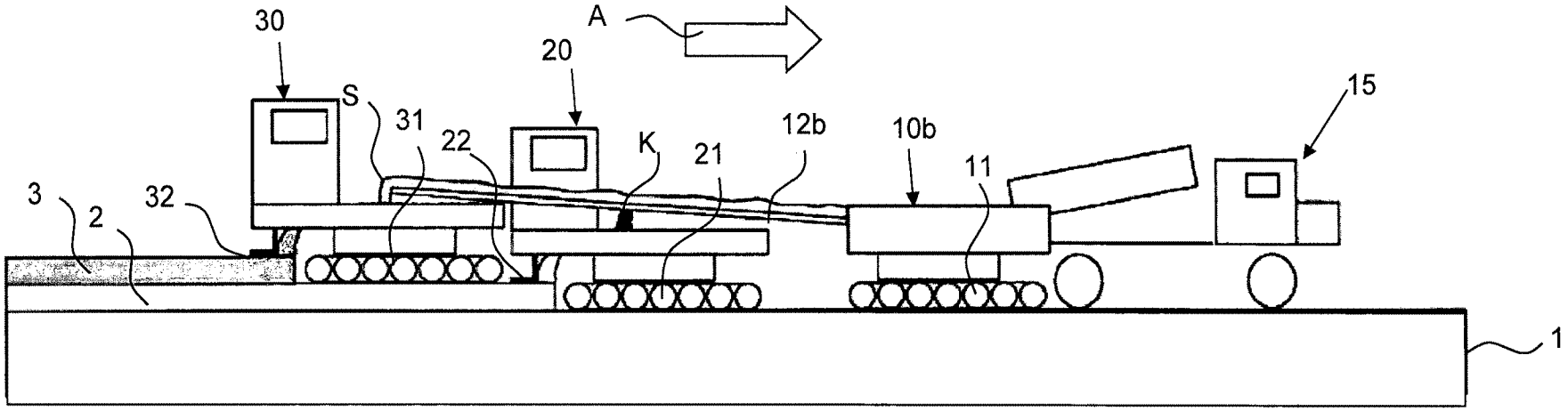
FIG. 2*a*, FIG. 2*b*.
Figure 2B:
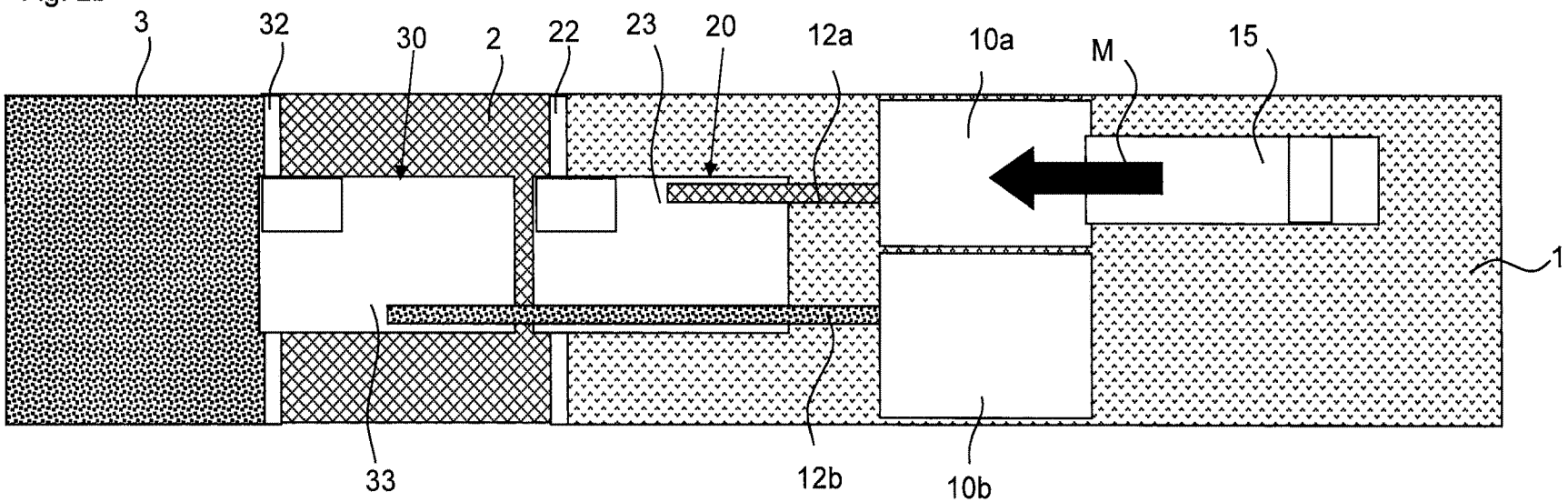

Both installation finishers 20, 30 are supplied continuously with the required materials K, S wherein the material K, which is required for installation of the PS layer 2 and can be e.g. a gravel-sand mixture, is supplied to the PSL finisher 20 by means of a conveying device 12*a* from a correlated open-top car 10*a* in which the material K is stored. Open-top car 10*a* and the conveying device 12*a* are hidden in the side view; only the material K dropping from the discharge end of the conveying device 12*a* into the receiving box 23 of the PSL finisher 20 can be seen here. Correspondingly, the material S, which is required for installation of the ballast layer 3 and usually is stone ballast of a certain grain size, is supplied to the ballast bed finisher 30 by means of a further conveying device 12*b* from a correlated open-top car 10*b* in which the material S is stored. The supply of the materials is realized therefore in a material conveying direction M which is opposite to the working direction A and which enables loading of the device with the materials K, S from the ground subgrade 1 by means of trucks 15, which in the illustrated example are dump trucks. The truck 15 is placed or driven in front of the open-top car to be loaded, here the open-top car 10*a* correlated with the PSL finisher 20, in such a way that—as can be seen in FIGS. 2*a,b*—the material contained in the dump body of the truck 15 during dumping is transferred into the provided open-top car 10*a* in material conveying direction M. The continuous installation of the PS layer 2 and of the ballast layer 3 is not interrupted during this because the truck 15, which has been switched to idle after docking at the open-top car 10*a*, is moved during dumping by the open-top car 10*a* forwardly in the working direction A.

For starting the method according to the invention, when at the beginning only the ground subgrade is present, a first PSL track section whose length corresponds approximately to the length of the ballast bed finisher can be pre-manufactured with conventional earthmoving equipment as a starting support surface for the entire device. On this first PSL track section, the ballast bed finisher for forming the work constellation can be received in that, in front of it, the PSL finisher and the open-top cars with the respective conveying devices are arranged on the ground subgrade in order to start simultaneously the method according to the invention with the components of the entire work constellation of PSL finisher, ballast bed finisher, and open-top cars that are working in parallel.

The conveying devices 12*a*, 12*b* extend from the respective open-top car 10*a*, 10*b* to the corresponding finisher 20, 30 or to its receiving box 23, 33. The open-top cars 10*a*, 10*b* can comprise a supply hopper whose neck opens at or above the receiving end of the conveying device 12*a*, 12*b*. Also, the receiving boxes 23, 33 can be designed as supply hoppers in order to supply the respective installation device 22, 32 with the material directly or by means of a further conveying device.

Figure 3A:
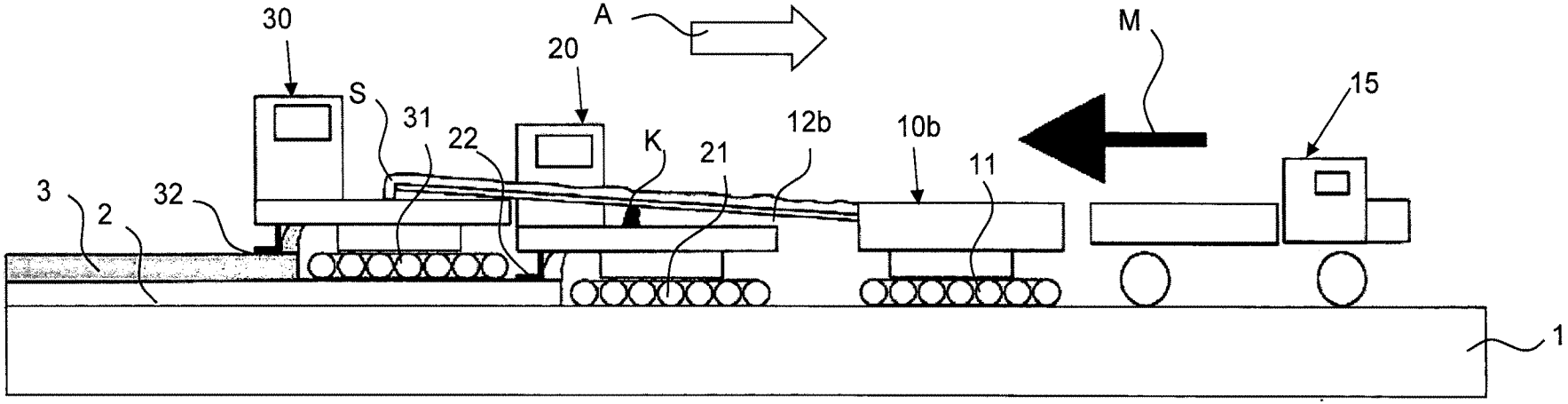
FIG. 3*a*, FIG. 3*b*.
Figure 3B:
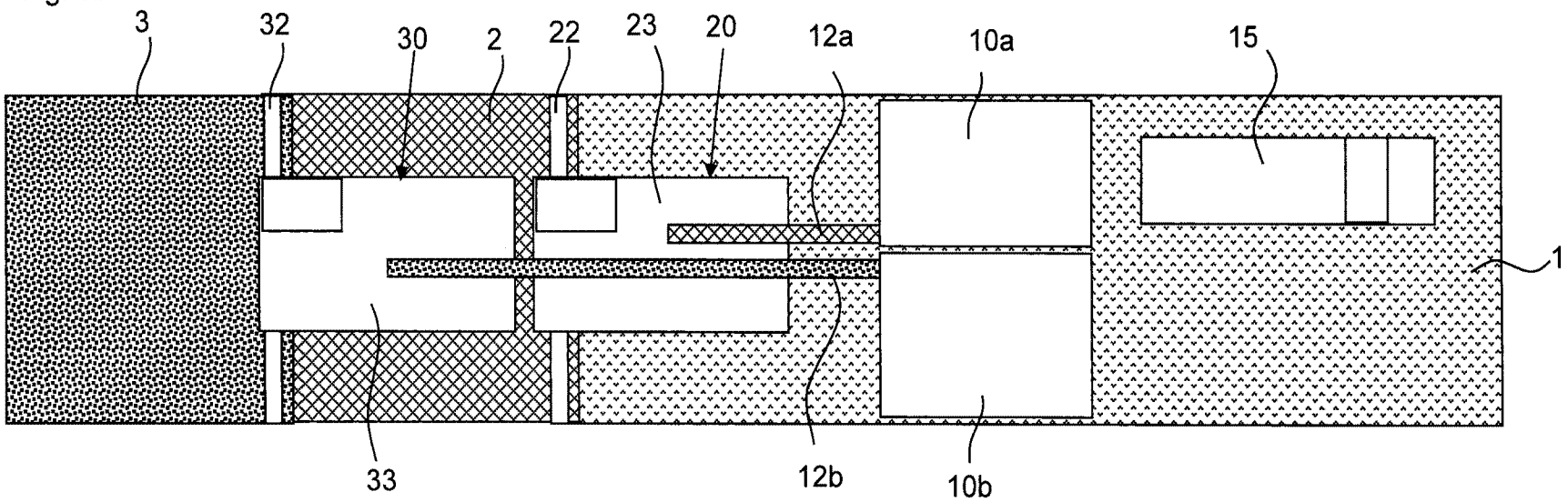
Figure 4A:
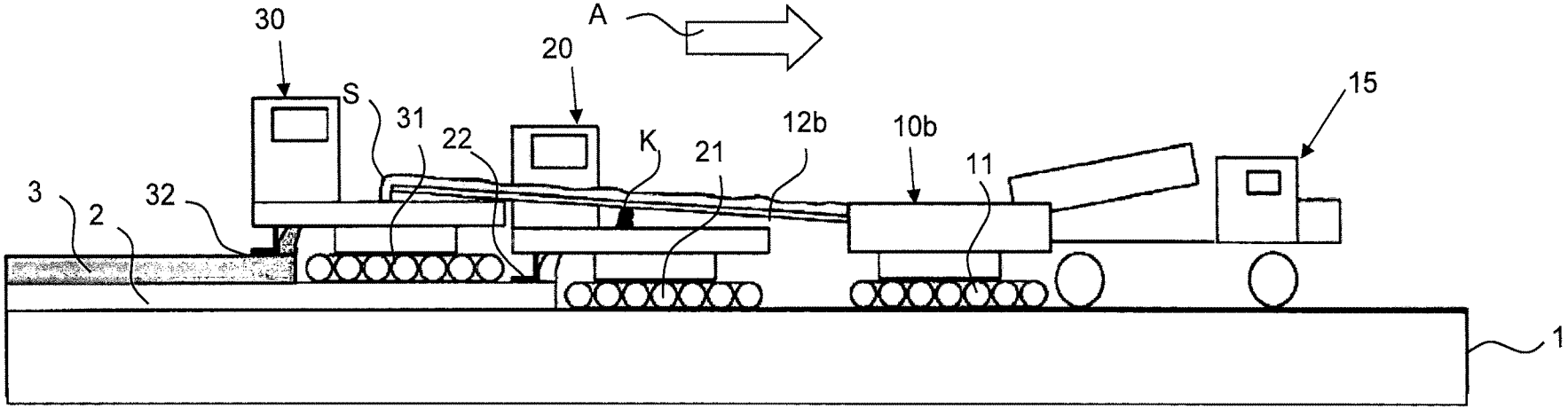
FIG. 4*a*, FIG. 4*b*.
Figure 4B:
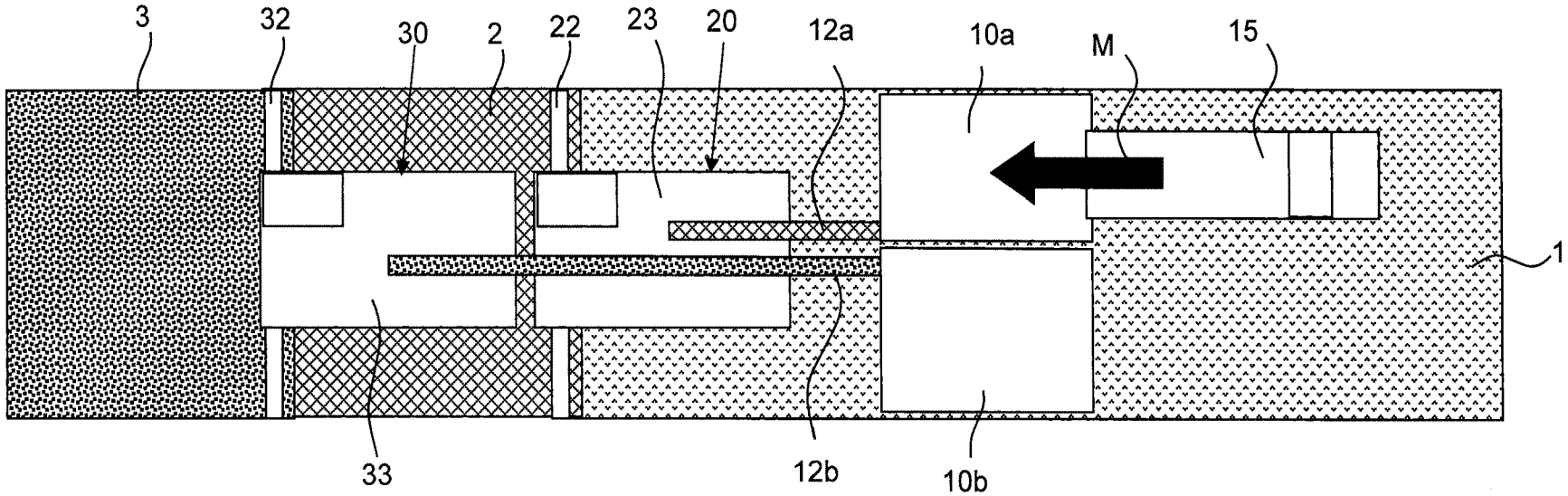

The example illustrated in FIGS. 3*a,b* and 4*a,b* differs from the device illustrated in FIGS. 1*a,b* and 2*a,b* in the arrangement of the conveying devices 12*a*, 12*b* which may be the result of a different arrangement of the respective receiving boxes 23, 33 at the PSL finisher 20 and ballast bed finisher 30. As needed, a more uniform filling of the respective receiving box can be achieved by means of the different arrangement of the conveying devices and the variation of the discharge position that is achieved thereby.

In order to be able to utilize differently constructed finishers 20, 30 in a device according to the invention, either different open-top cars 10*a*, 10*b* can be provided, which differ in the arrangement of the correlated conveying device 12*a*, 12*b* in relation to their position transverse to the working direction, or the conveying devices 12*a*, 12*b* can be designed to be adjustable in relation to this position so that, depending on the arrangement of the open-top cars 10*a*, 10*b* and construction of the employed finishers 20, 30, the discharge end of the conveying device 12*a*, 12*b* can be positioned optimally in relation to the respective receiving device 23, 33.

Moreover, the conveying devices, even though this is not illustrated, can be of a telescoping and/or rotational configuration in order to provide a variability also with regard to length and/or angle position and to thus be able to ensure, even in case of deviating arrangement and/or distance of the open-top cars and finishers, the arrangement of the discharge ends above the respective receiving devices of the respective finishers.

In FIGS. 1*a,b* to 4*a,b*, the device comprises respectively an open-top car 10*a*, which is correlated with the PSL finisher 20, and an open-top car 10*b*, which is correlated with the ballast bed finisher 30, wherein the two open-top cars 10*a*, 10*b* are operated adjacent to each other. Of course, deviations from the illustrated examples are conceivable within the claimed subject matter which extends also to work constellations in which a single open-top car is employed that comprises separate sections or separate supply hoppers for the respective materials so that the conveying devices extend from the respective sections/supply hoppers of the individual open-top car to the correlated finishers. Embodiments in which the open-top cars are not operated adjacent to each other but one after the other or displaced relative to each other, wherein the devices in these work constellations comprise correspondingly adapted conveying devices, are also in accordance with the invention.

Figure 7A:
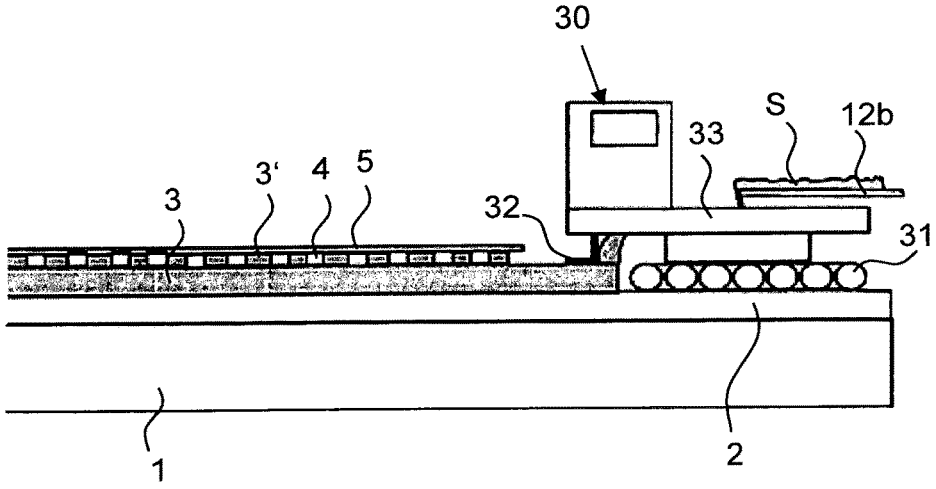
FIG. 7*a*, FIG. 7*b*, FIG. 7*c*.
Figure 7B:
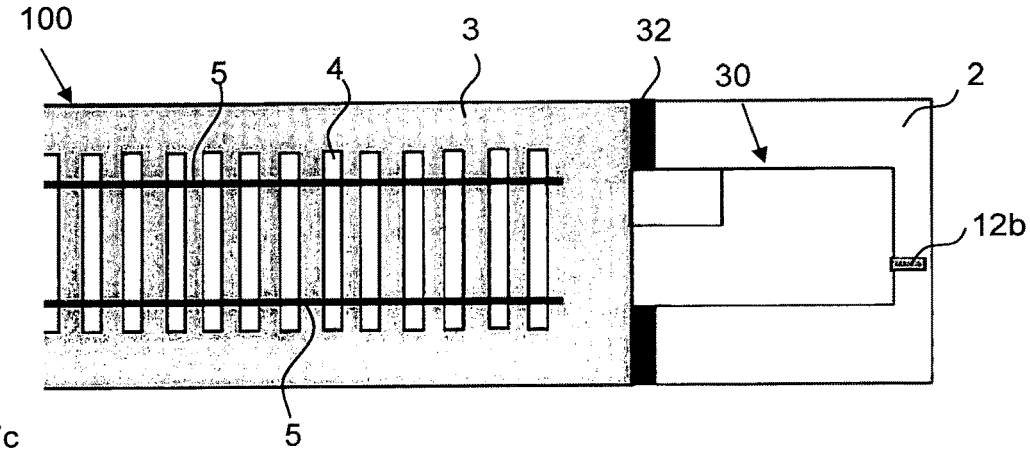
Figure 7C:
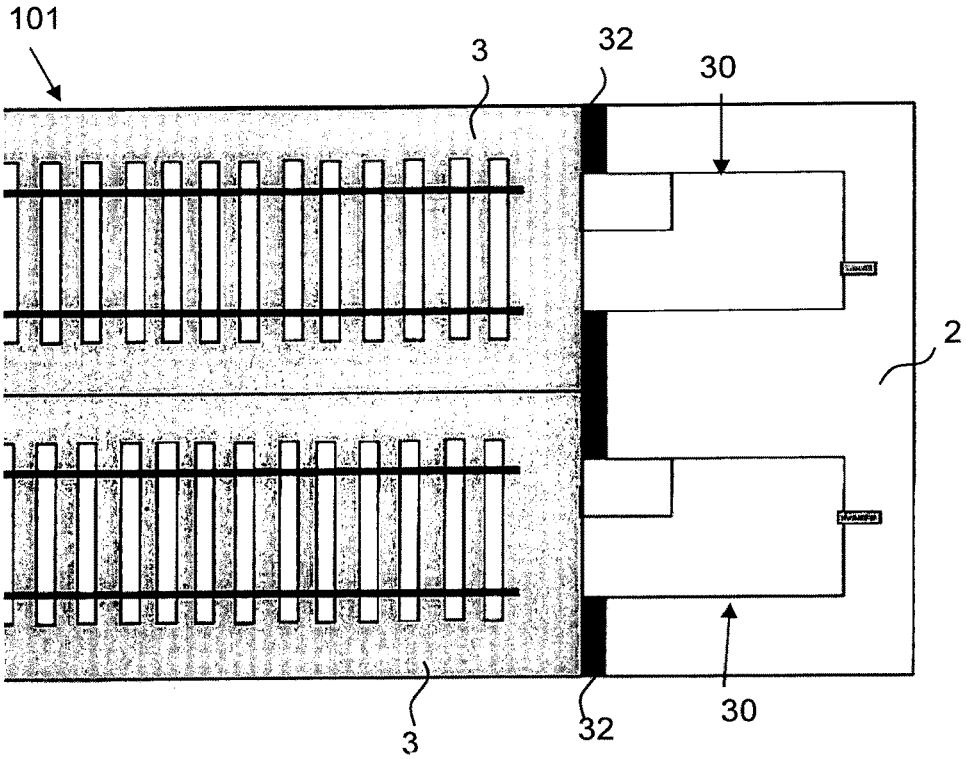

The exemplary illustration in FIGS. 7*a,b* shows how a single-track rail line 100 is completed, following the installation of the ballast layer 3 by means of the ballast bed finisher 30 of a device according to the invention, by arrangement of railroad ties 4 on the ballast bed 3 of the new ballastway, as needed, with introduction of fill ballast 3' between the railroad ties 4, and by attachment of the rails 5 on the railroad ties 4. FIG. 7*c* shows a double-track rail line 101 in which the new ballastway comprises two parallel ballast beds 3 and which can also be produced by the method according to the invention with a device according to the invention.

Figure 5A:
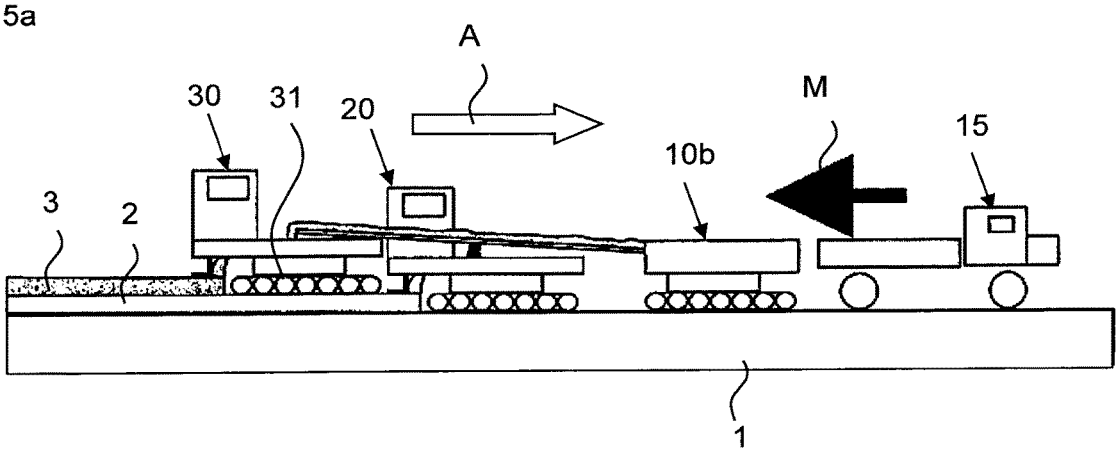
FIG. 5*a*, FIG. 5*b*.
Figure 5B:
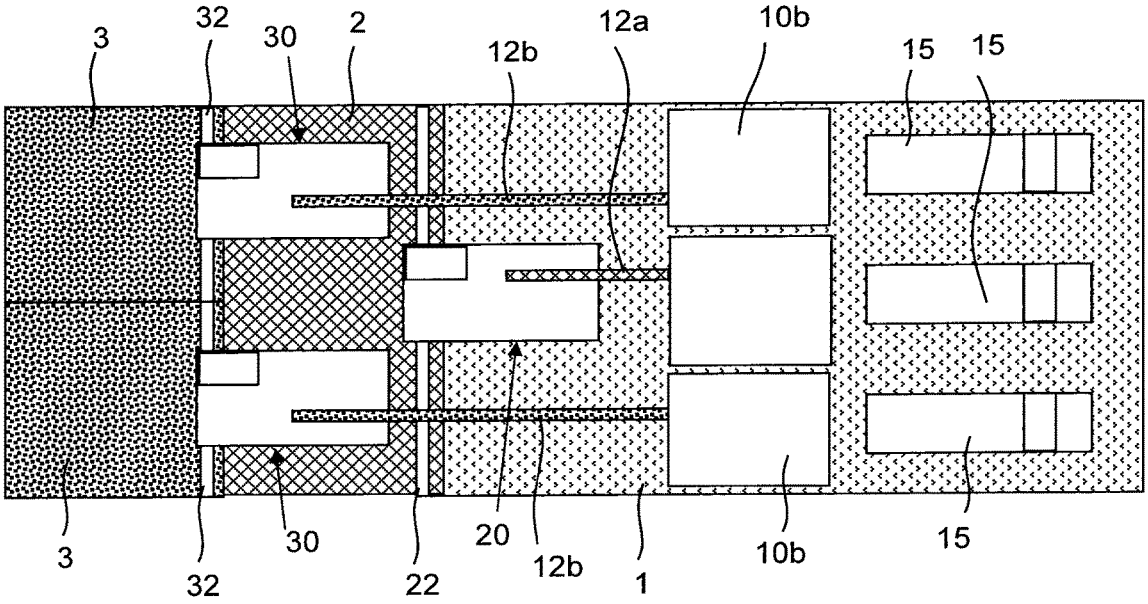
Figure 6A:
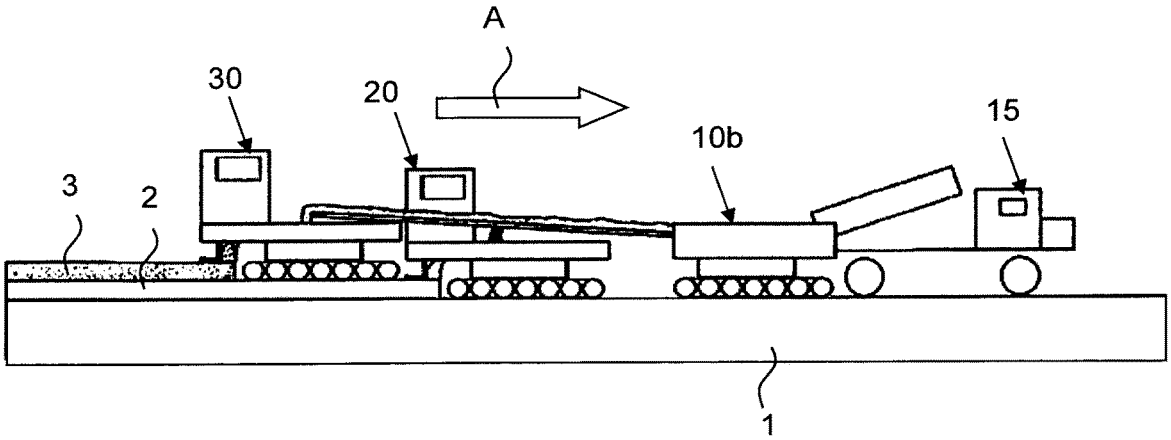
FIG. 6*a*, FIG. 6*b*.
Figure 6B:
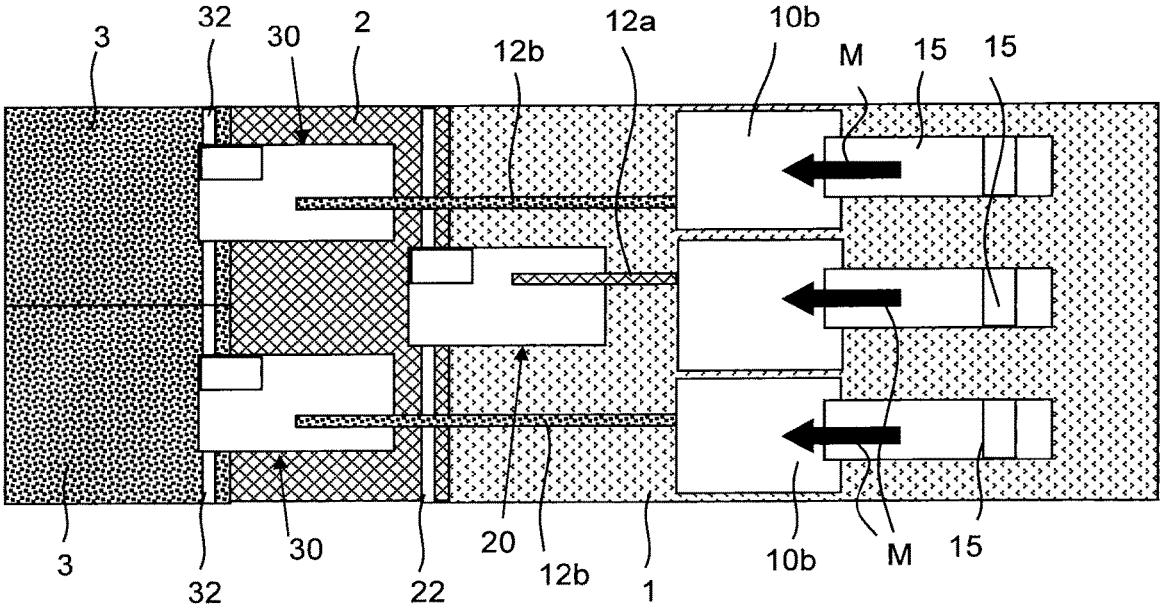

FIGS. 5*a,b* and 6*a,b* show in this context an exemplary embodiment of a device according to the invention for building such a double-track new ballastway. From the plan views of FIGS. 5*b* and 6*b* it is apparent that the device employed for this purpose, in accordance with the two ballast beds 3 to be built, comprises two ballast bed finishers 30 which comprise each a chain or crawler running gear 31 for traveling on the PS layer 2 and are operated at a predetermined distance behind the PSL finisher 20 which here installs the entire PS layer 2 by itself. The required material is supplied here also to the PSL finisher 20 by a conveying device 12*a* from the correlated open-top car 10*a* which is arranged in the illustrated example between two open-top cars 10*b* in which ballast is stored and from where a conveying device 12*b* extends respectively to the respective ballast bed finisher 30. Loading of the open-top cars 10*a*, 10*b* is done here also by trucks 15 which, as shown in FIGS. 6*a,b*, transfer the material by dumping into the respective open-top cars 10*a*, 10*b*.

Deviations from the illustrated example are conceivable here also within the claimed subject matter. For example, an alternative can provide that for storage of ballast only one open-top car is employed which is then however provided with two conveying devices in order to supply the two ballast bed finishers with material. A further alternative for building a double-track new ballastway can provide that a single ballast bed finisher is employed that comprises two installation devices. Depending on the width of the new ballastway, also more than one PSL finisher can be employed, as needed. The two PSL finishers can then be operated also adjacent to each other and, by means of corresponding conveying devices, be supplied with the material required for installation by their own correlated open-top car or by a common open-top car.

Moreover, it is understood that for producing multi-track new ballastways, i.e., new ballastways with more than two tracks of the line, the number of employed ballast bed finishers, as needed also of the PSL finishers, and of the correlated open-top cars and conveying devices is to be matched appropriately. For example, a work constellation for a three-track new ballastway can provide for the parallel use of three ballast bed finishers adjacent to each other behind a single PSL finisher that manufactures the PS layer for the three-track new ballastway across its entire width, wherein four open-top cars, one for PSL material and three for ballast, are operated in front of the PSL finisher. In this context, a conveying device extends from the open-top car for PSL material to the PSL finisher and a respective conveying device extends to one of the ballast bed finishers, respectively, from the three open-top cars for ballast. Of course, alternative work constellations with regard to the number of finishers and open-top cars or the number of installation devices, which have been described above in connection with the double-track new ballastway, are also conceivable here and are encompassed by the claimed subject matter. The same applies to new ballastways for four or even more tracks.

In principle, it is provided in accordance with the invention that the individual device components are linked electronically so that the individual work sequences are performed automated and linked. For complete automation, the installation finishers can be provided in addition with electronic surveying and leveling devices so that height and lateral positions of the layers can be controlled mechanically/electronically/by GPS.

Figure 13:
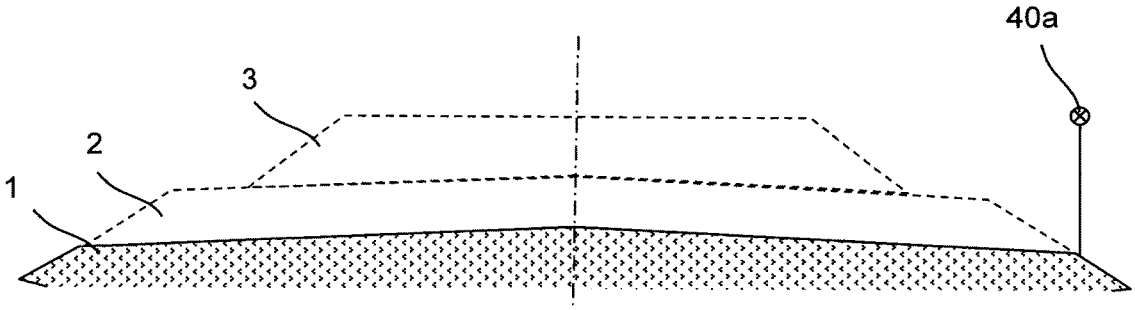
FIG. 13 a schematic cross section view of the ground subgrade for the single-track new ballastway of FIG. 12 with a guideline arranged at this lateral edge.
Figure 14:
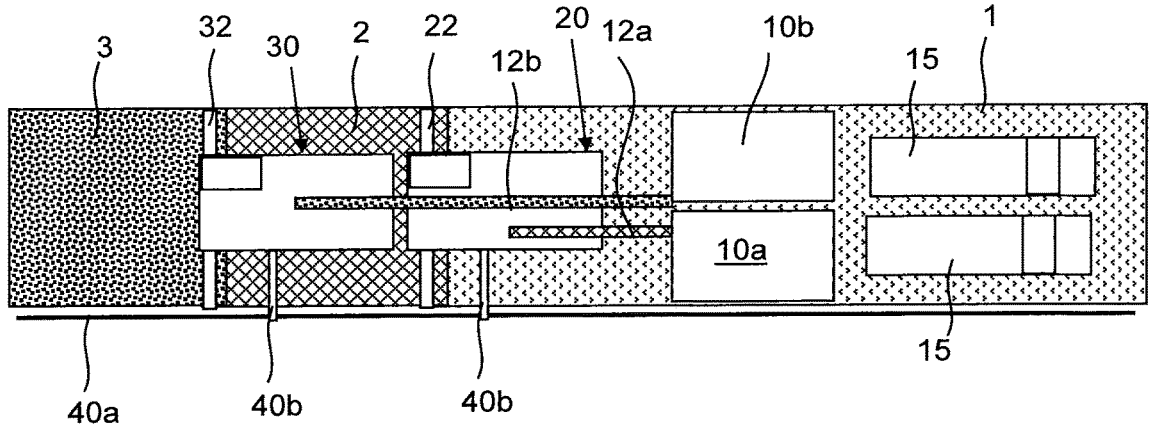
FIG. 14 a plan view of a device in work constellation according to an embodiment according to the invention for a single-track line with a guideline arranged at the lateral edge of the new ballastway.

FIGS. 13 and 14 show for this purpose a guideline 40*a* as well as sensing devices 40*b* of the finishers 20, 30 as surveying and leveling device. The guideline 40*a*, which is embodied as a wire string, is stretched along the lateral edge along the projected new ballastway at a previously calibrated height and is used during the method as a sensing line for the finishers 20, 30. The installation finishers 20, 30 continuously sense the measurement during forward movement. In this context, the guideline 40*a* provides the baseline (height/lateral position) of the layer to be installed. In FIG. 13, the layers 2, 3 to be installed are illustrated in dashed lines wherein the guideline 40*a* which extends perpendicularly to the plane of illustration is to be understood only as an example in regard to the illustrated height which corresponds here to the surface level of the ballast layer 3 to be installed. As a function of the forward movement (travel length), the installation parameters of the respective layer profile, i.e., slant, height, width and the like, that has been previously electronically stored in the control unit of the finisher based on the plan documentation, are autonomously determined by the control unit of the respective finisher, i.e., automatically. Alternatively, a manual control of slant, thickness, width and the like can also be performed by a driver of the finisher along the guideline.

The provided profile of the respective layer that is dependent on the projected new ballastway and comprises parameters such as layer thickness, layer slant, and layer width, can be adjusted by the installation finishers by a manual and/or automated control manner. In case of the manual control manner, the installation device of the respective installation finisher is manually adjusted in accordance with the intended profile. In case of the automated control manner, the respective installation device is adjusted by signals of the control unit in which the parameters of the respective profile are stored.

Figure 8A:
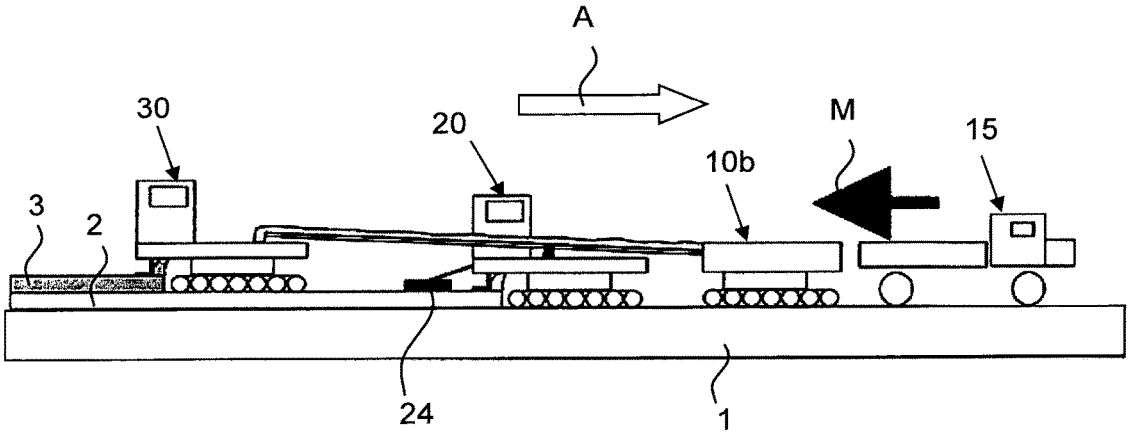
FIG. 8*a*, FIG. 8*b*.
Figure 8B:
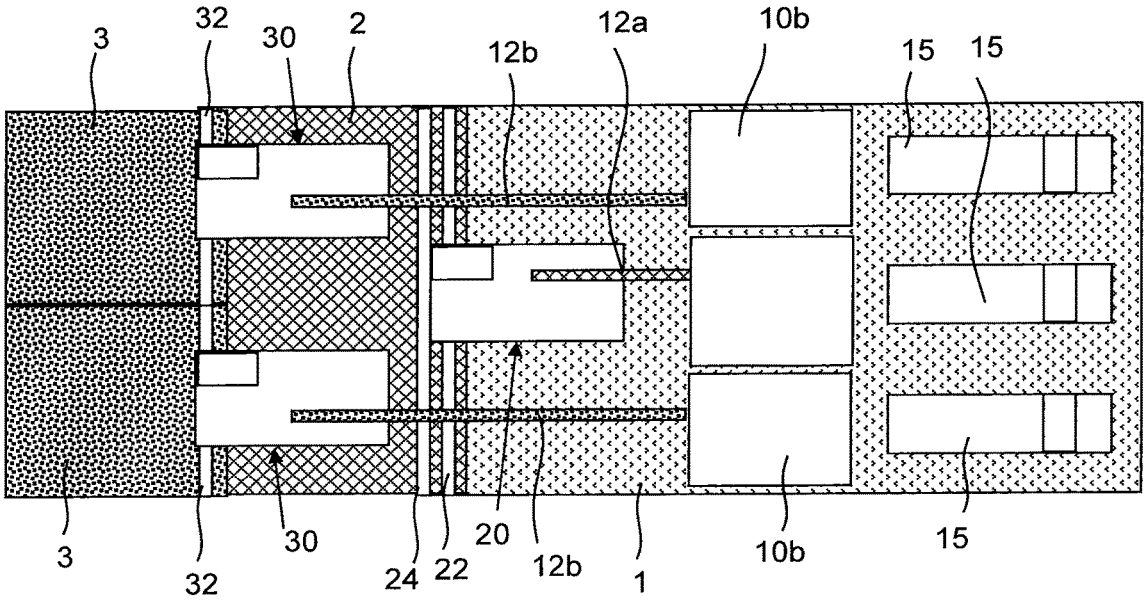
Figure 9A:
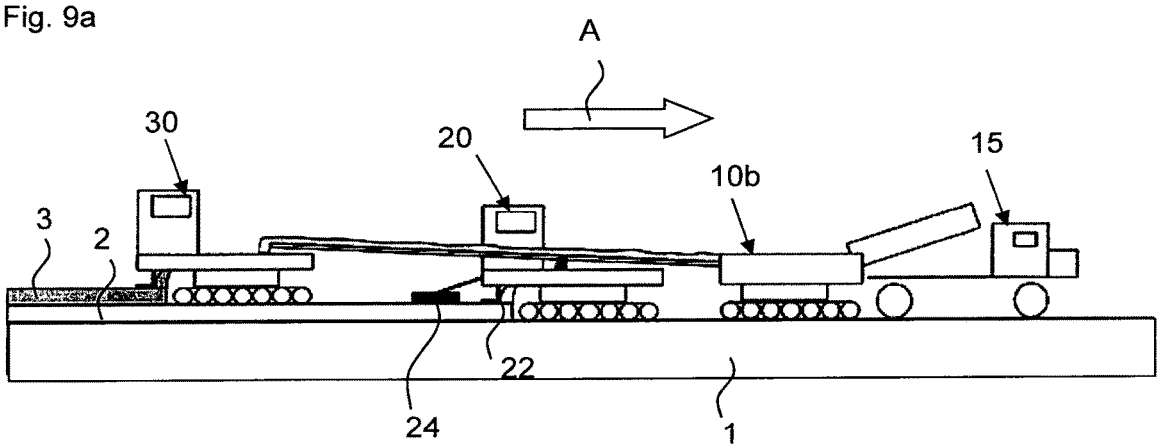
FIG. 9*a*, FIG. 9*b*.
Figure 9B:
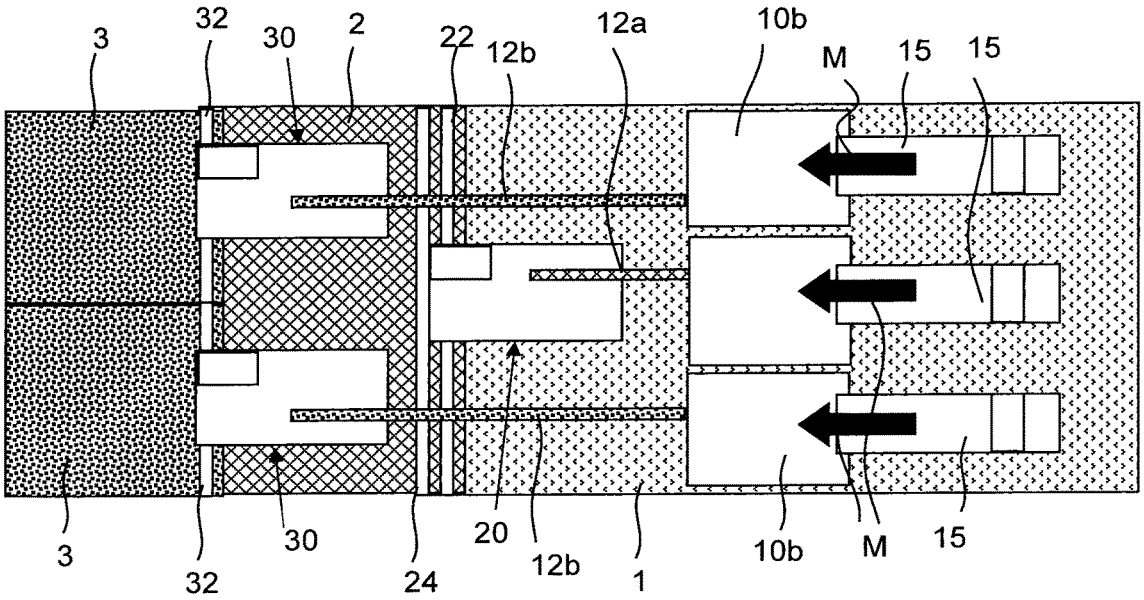
Figure 11A:
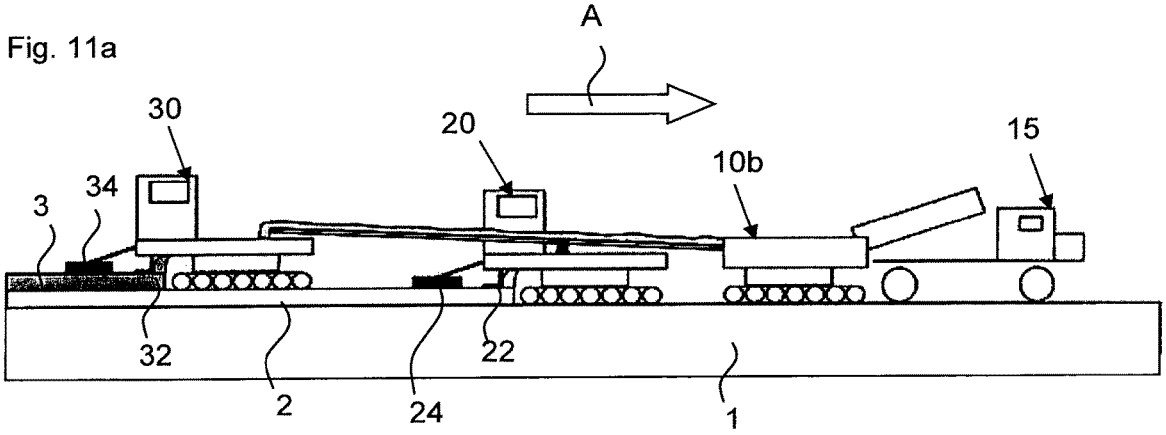
FIG. 11*a*, FIG. 11*b*.

Examples of further embodiments are illustrated in FIGS. 8*a,b* to FIGS. 11*a,b*. In FIGS. 8*a,b* and FIGS. 9*a,b*, the PSL finisher 20 has an additional leveling and compaction device, i.e., the compaction beam 24; in FIGS. 10*a,b* and FIGS. 11*a,b* the PSL finisher 20 shows the compaction beam 24 and the ballast bed finisher 30 has also a leveling or compaction device, namely also a compaction beam 34, in order to level and compact the installed PSL 2 or ballast layer 3, respectively.

The additional leveling and/or compaction devices 24, 34 are illustrated schematically here and are arranged behind the respective installation device 22, 23.

Figure 10A:
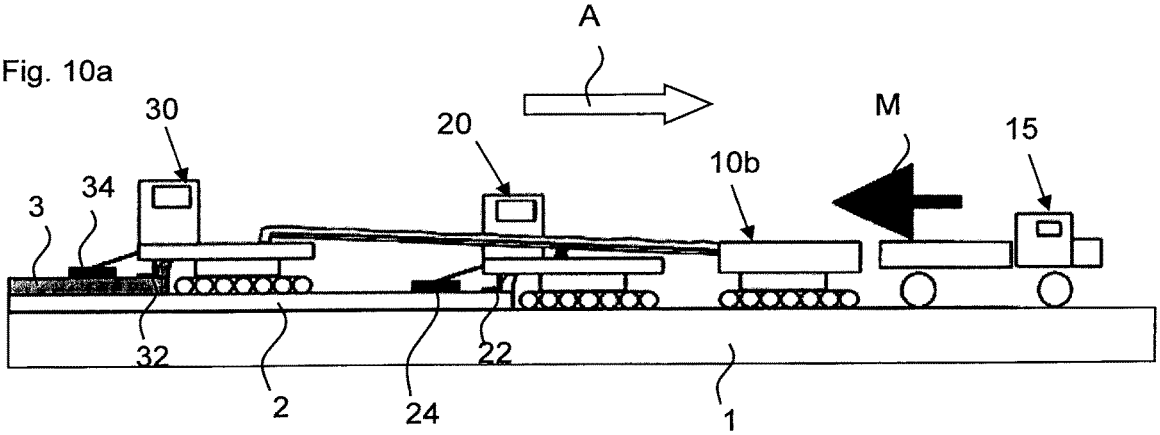
FIG. 10*a*, FIG. 10*b*.
Figure 10B:
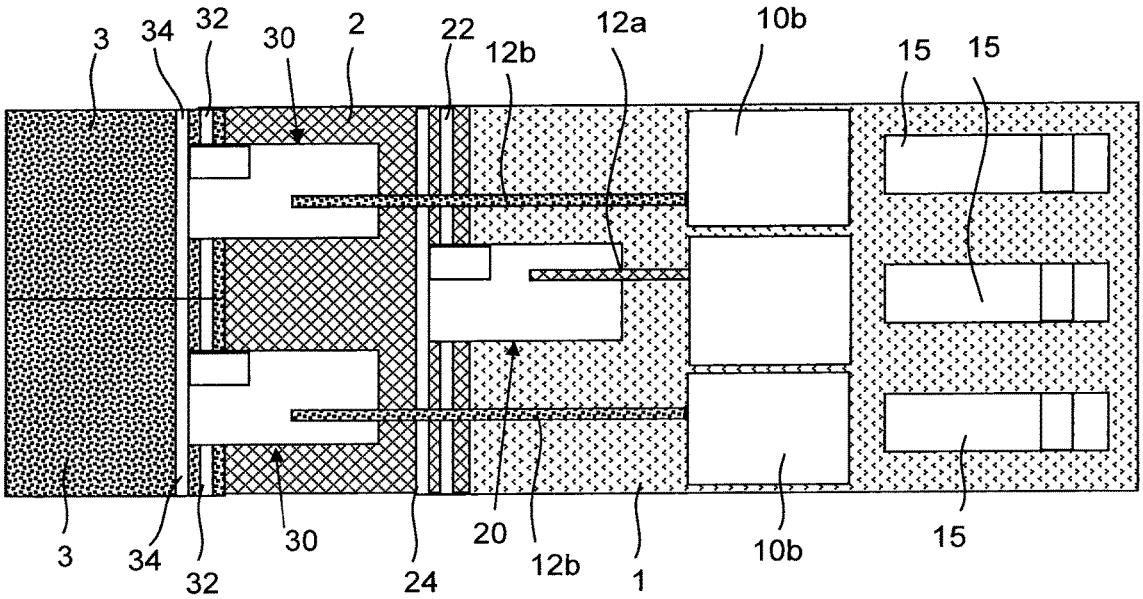
Figure 11B:
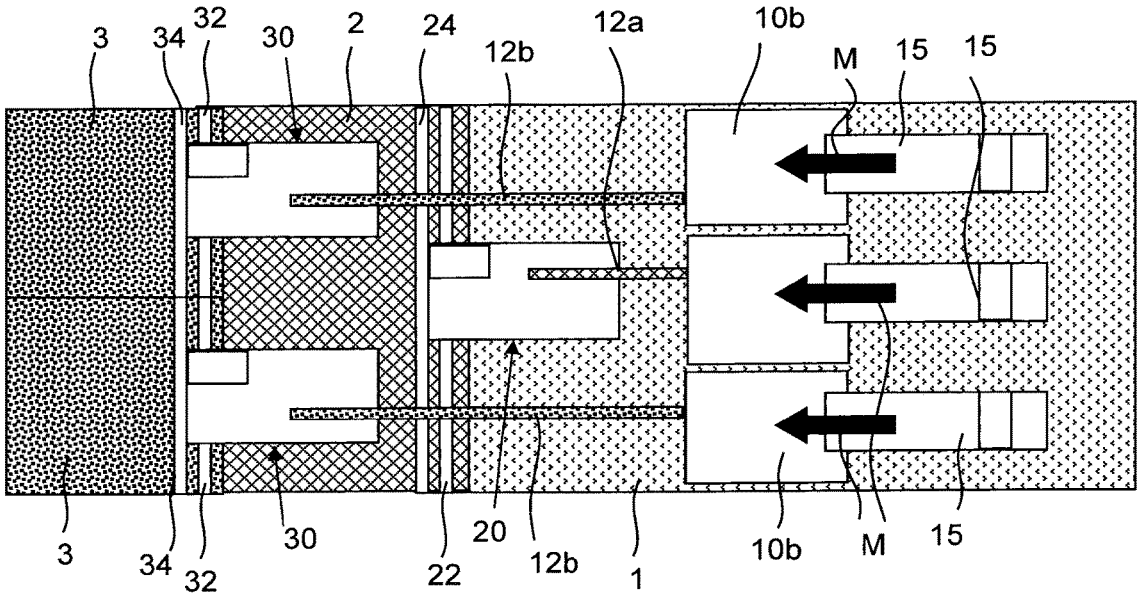

As illustrated in FIGS. 10*b* and 11*b*, the compaction beam 24 of the PSL finisher 20 extends across the entire width of the installed PSL 2 in order to level and compact according to the predetermined profile. The width of the compaction beam 34 of the ballast bed finisher 30 corresponds to the width of the respective ballast bed or the respective ballast layer 3, i.e., in the illustrated example of the double-track new ballastway to half of the total width. In deviation from the illustration, the width of the ballast layer can also be smaller than half of the total width of the double-track ballastway.

LIST OF REFERENCE CHARACTERS

1 ground subgrade
2 PS layer
3 ballast layer
3' fill ballast
4 railroad tie
5 rail
10*a* open-top car PSL material
10*b* open-top car ballast
11 crawler/chain running gear
12*a* conveying device PSL material
12*b* conveying device ballast
15 truck
20 PSL finisher
21 crawler/chain running gear
22 installation device
23 receiving box
24 compaction beam
30 ballast bed finisher
31 crawler/chain running gear
32 installation device
33 receiving box
34 leveling/compaction device
40*a*, 40*b* surveying and leveling devices
100 single-track rail line
101 double-track rail line
A working direction
M material direction
K PSL material
S ballast

What is claimed is:

1. A method for building a new ballastway for an at least single-track rail line (100, 101) for an initially non-existing track, wherein the new ballastway comprises at least a PS layer (2) and a ballast layer (3) and the PS layer (2) is built on a ground subgrade (1) and the ballast layer (3) is built on the PS layer (2) in a continuous work sequence in a working direction (A), the method comprising:

building the PS layer (2) by a PS layer finisher (20) (PSL finisher) and building the ballast layer (3) by a ballast bed finisher (30), the ballast bed finisher (30) operated at a predetermined distance behind the PSL finisher (20) in relation to the working direction (A) and provided with a chain or crawler running gear (31) for traveling on the PS layer (2), supplying material (K) required for building the PS layer (2) to the PSL finisher (20) by a respective correlated conveying device (12*a*) from at least one open-top car (10*a*, 10*b*) and supplying material (S) required for building the ballast layer (3) to the ballast bed finisher (30) by a respective correlated conveying device (12*b*) from the at least one open-top car (10*a*, 10*b*), the at least one open-top car (10*a*, 10*b*) operated at a predetermined distance in front of the PSL finisher (20) in relation to the working direction (A).

2. The method according to claim 1, further comprising:

storing the material (K) required for building the PS layer (2) in a first open-top car (10*a*) and transporting the material (K) from the first open-top car (10*a*) by the correlated conveying device (12*a*) to a receiving device (23) of the PSL finisher (20), and storing the material (S) required for building the ballast layer (3) in a second open-top car (10*b*) that is operated adjacent to the first open-top car (10*a*) and transporting the material (S) from the second open-top car (10*b*) by the correlated conveying device (12*b*) to a receiving device (33) of the ballast bed finisher (30).

3. The method according to claim 2, further comprising:

embodying the conveying devices (12*a*, 12*b*) to be adjustable in length, position and/or angle position, and positioning a discharge end of the conveying device (12*a*, 12*b*) in relation to the receiving device (23, 33).

4. The method according to claim 3, further comprising:

for producing a new ballastway for a double-track or multi-track rail line (101), employing a respective ballast bed finisher (30) for each of the tracks of the line to be constructed and employing the two or more ballast bed finishers (30) adjacent to each other, and supplying the material (S) required for building the respective ballast layer (3) to the ballast bed finishers (30) by a respective correlated conveying device (12*b*) from the at least one open-top car (10*a*, 10*b*), wherein preferably each ballast bed finisher (30) has correlated therewith its own open-top car (10*b*).

5. The method according to claim 1, further comprising:

installing the material (K) required for building the PS layer (2) by the PS finisher (20) by an installation device (22), wherein the installation device (22) installs the PS layer (2) according to a predetermined profile for the PS layer (2) comprising height, width, shape, position, and slant; and installing the material (S) required for building the ballast layer (3) by the ballast bed finisher (30) by an installation device (32), wherein the installation device (22, 32) installs the ballast layer (3) according to a predetermined profile for the ballast layer (3), comprising height, width, shape, position, and slant.

6. The method according to claim 5, further comprising:

surveying, leveling, and recording heights and lateral positions of the ground subgrade (1) and taking into consideration the heights and lateral positions of the ground subgrade (1) for predetermining the profile of the PS layer (2) and the profile of the ballast layer (3), wherein for surveying and recording the heights and lateral positions of the ground subgrade (1) preferably surveying and leveling devices (40*a*, 40*b*) are employed that are linked by at least one control unit with the installation devices (22, 32) so that the installation of the PS layer (2) with the predetermined profile of the PS layer (2) and the installation of the ballast layer (3) with the predetermined profile of the ballast layer (3) are performed in an automated manner.

7. The method according to claim 5, further comprising matching a travel speed of the PSL finisher (20), of the ballast bed finisher (30), and of the at least one open-top car (10*a*, 10*b*) and an installation speed of the PSL finisher (20) and of the ballast bed finisher (30) to each other, and matching a conveying speed of the conveying devices (10*a*, 10*b*) to the installation speed of the PSL finisher (20) and of the ballast bed finisher (20).

8. The method according to claim 5, further comprising:

leveling and/or compacting the installed PS layer (2) by a leveling and/or compaction device (24) of the PSL finisher (20), wherein the leveling and/or compaction device (24) of the PSL finisher (20) is arranged behind the installation device (22), and/or leveling and/or compacting the installed ballast layer (3) by a leveling and/or compaction device (34) of the ballast bed finisher (30), wherein the leveling and/or compaction device (34) of the ballast bed finisher (30) is arranged behind the installation device (32).

9. The method according to claim 1, further comprising:

loading the at least one open-top car (10*a*, 10*b*) with the materials (K, S) required for building the PS layer (2) and the ballast layer (3) by one or more trucks (15), wherein the one or more trucks (15) approach the at least one open-top car (10*a*, 10*b*) across the ground subgrade (1) from the front in relation to the working direction (A).

* * * * *